US011639242B2

(12) United States Patent
Venugopal et al.

(10) Patent No.: US 11,639,242 B2
(45) Date of Patent: May 2, 2023

(54) NONWOVEN STERILE PACKAGING

(71) Applicant: Carl Freudenberg KG, Weinheim (DE)

(72) Inventors: Arun Prasad Venugopal, Weinheim (DE); Nicolas Bernhard, Mannheim (DE); Thomas Hofbauer, Hirschberg (DE); Klaus-Dietmar Wagner, Heddesheim (DE)

(73) Assignee: CARL FREUNDENBERG KG, Weinheim (DE)

( * ) Notice: Subject to any disclaimer, the term of this patent is extended or adjusted under 35 U.S.C. 154(b) by 649 days.

(21) Appl. No.: 16/244,114

(22) Filed: Jan. 10, 2019

(65) Prior Publication Data

US 2019/0210754 A1 Jul. 11, 2019

(30) Foreign Application Priority Data

Jan. 11, 2018 (EP) ..... 18151271

(51) Int. Cl.

| | |
|---|---|
| ***D04H 3/016*** | (2012.01) |
| ***B65B 55/02*** | (2006.01) |
| ***B65B 11/48*** | (2006.01) |
| ***D04H 1/56*** | (2006.01) |
| ***D04H 3/14*** | (2012.01) |
| *D04H 3/011* | (2012.01) |
| *D04H 3/007* | (2012.01) |

(52) U.S. Cl.

CPC ..... *B65B 55/02* (2013.01); *B65B 11/48* (2013.01); *D04H 1/56* (2013.01); *D04H 3/016* (2013.01); *D04H 3/14* (2013.01); *D04H 3/007* (2013.01); *D04H 3/011* (2013.01); *D10B 2321/021* (2013.01); *D10B 2505/10* (2013.01)

(58) Field of Classification Search

CPC .. D04H 3/007–011; D04H 3/016; D04H 3/14; D04H 3/16; D04H 1/544; D04H 1/55; D04H 1/56–565; A61L 2/0035; B65B 55/02; B65B 11/48

See application file for complete search history.

(56) References Cited

U.S. PATENT DOCUMENTS

| | | | |
|---|---|---|---|
| 5,273,565 | A | 12/1993 | Milligan et al. |
| 6,034,008 | A | 3/2000 | Lim et al. |

(Continued)

FOREIGN PATENT DOCUMENTS

| | | | |
|---|---|---|---|
| CN | 1648011 | A | 8/2005 |
| CN | 101495208 | A | 7/2009 |

(Continued)

OTHER PUBLICATIONS

"Calendering.", "Nonwoven fabric.", "Wet forming." Complete Textile Glossary, New York, NY: Celanese Acetate, 2001. N. pag. Print. (Year: 2001).*

*Primary Examiner* — Larissa Rowe Emrich

(74) *Attorney, Agent, or Firm* — Leydig, Voit & Mayer, Ltd.

(57) ABSTRACT

A packaging for sterile packaging application includes: a single layer nonwoven fabric obtained from a nonwoven, the nonwoven including meltblown polymer fibers having an average fiber diameter between 2 μm to 10 μm and a standard deviation of the fiber diameter of at least 100%. The nonwoven is thermally bonded.

20 Claims, 3 Drawing Sheets

(56) References Cited

U.S. PATENT DOCUMENTS

| | | | | |
|---|---|---|---|---|
| 6,319,865 | B1 * | 11/2001 | Mikami | D04H 1/56 442/400 |
| 6,349,826 | B1 * | 2/2002 | Kapik | D21H 27/10 162/146 |
| 2005/0092636 | A1 * | 5/2005 | Su-Syin | B65B 55/18 206/363 |
| 2008/0026659 | A1 | 1/2008 | Brandner | |
| 2008/0160861 | A1 | 7/2008 | Berrigan et al. | |
| 2008/0318024 | A1 * | 12/2008 | Angadjivand | D01D 4/025 428/311.51 |
| 2009/0117803 | A1 * | 5/2009 | Jung | D04H 3/016 442/344 |
| 2010/0263108 | A1 | 10/2010 | Marin et al. | |
| 2011/0070125 | A1 * | 3/2011 | Williams | A61L 2/204 422/36 |
| 2014/0079589 | A1 * | 3/2014 | Landgrebe | A61L 2/26 422/28 |
| 2014/0305090 | A1 * | 10/2014 | Kuroda | D04H 3/016 55/528 |
| 2015/0211158 | A1 | 7/2015 | Hassan et al. | |
| 2015/0211160 | A1 | 7/2015 | Hassan et al. | |
| 2015/0322602 | A1 | 11/2015 | Brown et al. | |
| 2017/0137970 | A1 * | 5/2017 | Pourdeyhimi | D04H 1/724 |
| 2017/0152616 | A1 * | 6/2017 | Brown | D04H 3/14 |
| 2017/0211216 | A1 | 7/2017 | Brown et al. | |

FOREIGN PATENT DOCUMENTS

| | | | |
|---|---|---|---|
| WO | WO 2015171707 | A1 | 11/2015 |
| WO | WO 2015195648 | A2 | 12/2015 |

* cited by examiner

NONWOVEN STERILE PACKAGING

CROSS-REFERENCE TO PRIOR APPLICATION

Priority is claimed to European Patent Application No. EP 18 151 271.6, filed on Jan. 11, 2018, the entire disclosure of which is hereby incorporated by reference herein.

FIELD

The invention relates to packaging for sterile packaging application comprising a single layer nonwoven fabric obtained from a nonwoven of meltblown polymer fibers. The packaging is especially suited as a medical packaging.

BACKGROUND

In industrial packaging applications, especially in the technical field of medicine, there is a high demand for sterile packaging materials. Such sterile packaging materials are required for standard packaging of various compositions and agents, such as drugs and medical liquids, or devices, such as syringes or wound dressings. Sterile packaging materials must have a specific combination of advantageous properties. Most importantly, they must have a relatively high stability. This is necessary, because standard sterilization processes are carried out under harsh conditions, for example with γ-radiation, under heat or pressure and/or in the presence of harsh chemicals, such as ethylene oxide. If a packaging material does not have sufficient stability, it is damaged in the sterilization process and the packed object can be contaminated. Further, a sterile packaging material should be mechanically stable, in order to avoid damage and consecutive contamination in the production process, during storage, transport and the like. A stable packaging material should also have high air permeability as a pre-requisite for sterilization with chemicals. Nonetheless a sterile packaging material must provide a high barrier function against germs, such as bacteria or viruses. For standard applications, sterile packaging materials should also be relatively lightweight, transparent and available at low costs.

Common packaging materials, such as paper or plastic film, are not suitable for sterile packaging, because they lack sufficient mechanical stability for the sterilization process, but also air permeability and/or barrier function.

Conventional nonwoven fabrics are also not suitable for sterile packaging applications. Conventional spunlaid nonwovens have relatively large fiber diameters in the range of about 15 μm to 100 μm. The relatively thick fibers confer a high mechanical strength to the nonwovens. However, the barrier function of the nonwovens against bacteria and viruses is insufficient, because the pore sizes, which are typically larger than 15 μm, are too high.

Fine fibers having diameters in the range of about 1 μm to 5 μm are available by a conventional meltblow process. The pore sizes of meltblown nonwovens are low and they can provide an efficient barrier against bacteria or viruses. However, the very fine fibers only confer low mechanical strength to the nonwovens. Therefore, meltblown nonwovens are normally damaged in standard sterilization methods, for example with γ-radiation. Further, the low mechanical strength increases the general risks of damages during production and handling and consecutive decontamination. Therefore, standard meltblown nonwovens are generally not suitable and not used for sterile packaging applications.

In order to overcome such known problems of spunbond nonwovens or meltblown nonwovens, in the art different nonwoven materials are laminated for use as sterile packagings. Typical materials are three or four layered laminates known as SMS (spunbond-meltblown-spunbond) or SMMS materials. Various nonwoven layers can be combined and adhered to each other, typically by thermal bonding. As a result, sandwich-like structures are obtained, which have a barrier function due to meltblown layers and mechanical strength due to the spunbond layers. However, it is a problem that such materials tend to delamination. Therefore, there is a relatively high risk of decontamination in the production process and handling. Further, the production process, which comprises nonwoven production and lamination steps, is relatively complicated.

In order to overcome such problems, porous materials have been developed in the art, which have a higher stability than conventional meltblown or spunlaid nonwovens. In this regard, a benchmark product for medical sterile packaging applications, but also for various other applications, is commercially available under the trademark Tyvek from DuPont, U.S. The porous sheet material is obtained by a so-called "flash-spinning" process from high-density polyethylene. In flash-spinning, a dissolved resin is sprayed into a chamber, in which the solvent evaporates and a porous solid sheet remains. The sheet comprises fiber like sections, which are linked by knots. The product is structurally different from a conventional nonwoven. However, a typical flashspun porous sheet as such does not have sufficient stability for sterile packaging applications. Therefore, it is normally combined and reinforced with nonwoven webs having relatively large fibers by calendering. Flashspun porous sheets are described, for example, in US 2010/0263108 A1, US 2008/0220681 A1 or U.S. Pat. No. 6,034,008. Flashspun porous sheets have various drawbacks with regard to sterile packaging applications. Since the products are generally laminates, the problem of delamination is also observed. Delamination can especially occur in downstream steps of the production process. Further, flashspun porous sheets are not highly homogenous. Since they are not formed from regular fibers as conventional nonwovens, the irregularity of the structure is relatively high. Another problem is that the porous sheets are typically produced from high-density polyethylene having a melting point between 130° C. and 145° C. Such a low melting point is problematic, when the material is sterilized at elevated temperatures. Further, also the printability of such materials with labels or the like is limited.

In the last years, methods have been described in the art for producing nonwovens having a relatively broad fiber diameter distribution. For example, nonwovens comprising fibers of relatively large and small diameter can be produced with a multi-row meltblowing system, wherein each individual spinning nozzle is surrounded by concentric air jets. Such a process leads to high swirling of emerging polymer strains in the air streams, which results in increased fiber stretching and attenuation, and thereby in fibre sections of relatively high and low diameter. Overall, nonwovens are obtainable in which fibers having relatively high and low fiber diameters are intimately mingled. For example, such devices and processes are disclosed in US 2017/0211216 A1, US 2015/0322602 A1, WO2015/171707 A1 or US 2017/152616 A1.

Fiber diameter variability can also be increased, when fibers are spun onto one single deposit from two or more spinnerets. Thereby, fibers of different diameters can be produced simultaneously, intermingled and laid down as one single nonwoven. Such methods are described in US 2017/0137970 A1 (WO2015/195648) or US 2015/211158 A1.

U.S. Pat. No. 5,273,565 relates to a meltblown web composed of fibers having a narrow fiber size distribution. US 2008/0160861 A1 relates to a nonwoven fibrous web of meltblown fibers which shall have a high dimensional stability.

Overall, there is a continuous and high demand for improved materials for sterile packaging, especially for medical applications, which overcome the above mentioned drawbacks.

SUMMARY

In an embodiment, the present invention provides a packaging for sterile packaging application, comprising: a single layer nonwoven fabric obtained from a nonwoven comprising meltblown polymer fibers having an average fiber diameter between 2 μm to 10 μm and a standard deviation of the fiber diameter of at least 100%, wherein the nonwoven is thermally bonded.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 1 shows a top view of a nonwoven fabric produced according to example 2 at 250× magnification.

FIG. 2 shows a top view of another nonwoven fabric produced according to the inventive process at 25× magnification.

FIG. 3 shows a cross-section of the nonwoven fabric shown in FIG. 2 at 50× magnification.

DETAILED DESCRIPTION

Figure 1:
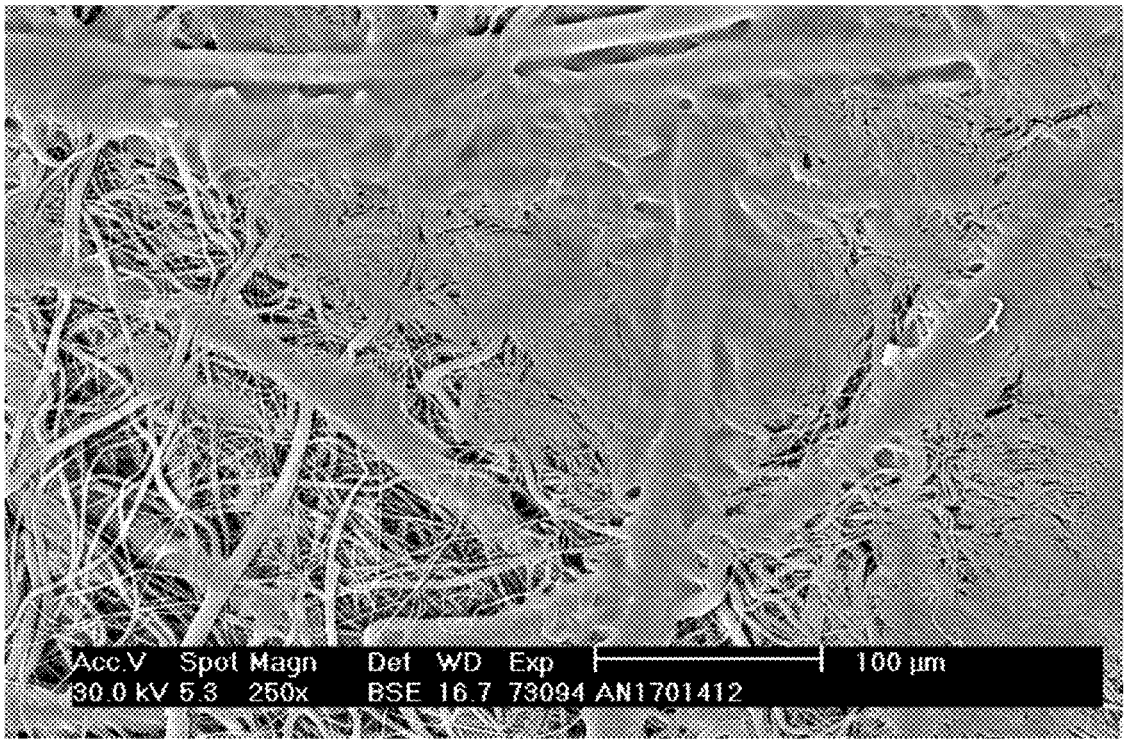
FIGS. 1, 2 and 3 show scanning electron microscope (SEM) images of nonwoven fabrics produced according to the examples.

The problem underlying the invention is to provide packaging materials, articles, uses and methods which overcome the above mentioned drawbacks.

Specifically, a packaging shall be provided which is applicable for sterile packaging applications, especially in the medical field. The packaging shall have a high mechanical strength and a high barrier function against germs, such as bacteria or viruses. The packaging shall be stable in standard sterilization processes, such as sterilization by high energy radiation, especially γ-radiation, under high-temperature or pressure, and/or by treatment with reactive chemicals, such as ethylene oxide. The packaging should also have a high mechanical strength, such that it does not have a tendency to damages, such as rupture, tearing, or delamination, in the production process or during handling.

It is a further problem that the material shall be relatively uniform. Preferably, it shall have a narrow pore size distribution.

It is a further problem that the material should combine high stability with a high elasticity, such that it can be used conveniently in standard packaging methods and applications.

It is a further problem that the material should be easily available by a standard production process. Especially for cost and environmental reasons, it shall be lightweight and available in a simple and efficient process.

Surprisingly, it was found that the problem underlying the invention is overcome by packagings, uses, methods and articles according to the claims. Further embodiments of the invention are outlined throughout the description.

Subject of the invention is a packaging for sterile packaging application, comprising a single layer nonwoven fabric obtained from a nonwoven. The nonwoven comprises meltblown polymer fibers having an average fiber diameter between 2 μm to 10 μm and a standard deviation of the fiber diameter of at least 100%. The nonwoven is thermally bonded.

As used herein, the term "packaging" refers to a material, which is configured for packing an object. The object is thus enclosed in the packaging. The packaging may be provided in an appropriate shape and form for packing the object. It comprises the nonwoven fabric and may comprise other functional means for a packaging application, such as labels or means for locking or sealing. The object packed in the packaging is referred to as a packed article.

The packaging comprises a nonwoven fabric. The nonwoven fabric is obtained by thermal bonding from the nonwoven obtained by meltblowing. The nonwoven fabric is the material which encloses the object and separates it from the environment. Preferably, the nonwoven fabric encloses the object completely. More preferably, the object is sealed in the nonwoven fabric. Then, there are no holes or other portions of the packaging wherein the object is still in direct contact with the environment. In the inventive packaging, the nonwoven fabric is configured for packing. For example, it can be configured for packing by conversion into an appropriate shape and form or by combination with functional means for a packaging application, such as a label.

The nonwoven fabric is a single layer nonwoven fabric. This means that the nonwoven fabric is not a laminate. It was obtained from a single layer nonwoven by thermal bonding. The single layer nonwoven fabric was not obtained by laminating two or more layers of nonwovens together.

The nonwoven, from which the nonwoven fabric is obtained by thermal bonding, is obtained by meltblowing. Thus, the nonwoven and the nonwoven fabric comprise meltblown polymer fibers. In the technical field of nonwovens, the term "meltblowing" essentially refers to a spinning process, in which thermoplastic fiber forming polymer is melted in an extruder, pumped through die holes and enters high-speed air streams when leaving the spinning nozzles. The streams of hot air normally exit from the sides of the nozzles, guide the extruded polymer streams and lead to formation of very fine filaments. The filaments are deposited on a collector screen, whereby a relatively fine, typically self-bonded nonwoven web is formed. The meltblow process is different from conventional spunlaid technology, in which the emerging polymer fibers are not guided by air streams from nozzles in the spinneret, but normally only drawn onto a conveyor belt by suction.

When the meltblown polymer fibers are collected on a surface below the meltblowing device, the nonwoven is obtained. According to the invention, the fibers of this nonwoven, before the thermal bonding step, have an average fiber diameter between 2 μm to 10 μm and a standard deviation of the fiber diameter of at least 100%. Subsequently, the nonwoven is thermally bonded to become the nonwoven fabric.

The nonwoven and the nonwoven fabric, which is used for producing the packaging of the invention, are characterized by a specific combination of a relatively low average fiber diameter with a relatively broad fiber diameter distribution.

The average fiber diameter of the nonwoven is between 2 μm and 10 μm. In a preferred embodiment, the average fiber diameter is between 3 μm to 7 μm. More preferably, the average fiber diameter is between 3.5 and 5.5 μm. It was found that a packaging with advantageous mechanical stability and barrier function is obtainable when adjusting the average fiber diameter in this range, in combination with a relatively broad fiber diameter distribution. Since fibers in the nonwoven are obtained by meltblowing, the fiber diameter is normally not uniform along the fiber length. Rather, the individual fibers typically comprise subsections of higher and lower diameter.

Preferably, the fiber diameter is determined by scanning electron microscope (SEM) analysis. Preferably, the probes are gold-sputter coated. In this method, nonwoven webs are cut and placed onto carbon tape, fixed onto a metal stub, which then is gold sputter-coated. The sputter-coated sample stubs are then pictured by SEM with different magnifications and pictures are obtained. The pictures are fed into standard software (Image Access V12, Image Bildverarbeitung AG, CH) where the standard ruler at the bottom of each SEM picture is used as a reference to measure the fiber diameters manually. Statistical plots (average, standard deviation and CV %) are then made with Microsoft Excel.

The nonwoven is characterized by a relatively broad fiber diameter distribution. Accordingly, the standard deviation of the fiber diameter from the average fiber diameter is at least 100%. In other words, when the fiber diameter is, for example, 4 μm, a relatively high number of fibers has significantly lower or higher fiber diameter. In a preferred embodiment, the standard deviation of the fiber diameter from the average fiber diameter is at least 150%. More preferably, the standard deviation is at least 170%. It is preferred that the standard deviation of the fiber diameter is less than 400%, more preferably less than 300%, and even more preferably less than 220%. Specifically, it is preferred that the standard deviation is in the range of 100% to 400%, preferably between 150% and 300%, or especially between 170% and 220%. In absolute terms, it is preferred that the standard deviation of the fiber diameter is at least 4 μm, more preferably at least 6 μm, and most preferably at least 7 μm. The standard deviation is preferably less than 20 μm, preferably less than 15 μm, and especially less than 12 μm. Preferably, the standard deviation is between 2 and 20 μm, more preferably between 6 and 15 μm, even more preferably between 7 and 12 μm. The standard deviation is preferably determined by the following formula:

$$\sigma = \sqrt{\frac{\sum (x-\mu)^2}{N}}$$

Where a is the standard deviation, Σ is the "sum of the following equation", x is a value in the data set, μ is the mean or average of the data set and N is the number of data points in the population. The relatively high standard deviation is advantageous. Without being bound to theory, it is assumed that the rather fine fibers provide an efficient barrier of the packaging against contamination, whereas the rather thick fibers confer mechanical stability to the packaging.

The nonwoven comprises fibers having a relatively small diameter and fibers having a relatively high fiber diameter. In a preferred embodiment, the nonwoven comprises fibers having a diameter between 0.1 and 2 μm and also fibers having a diameter between 20 and 40 μm. More preferably, the nonwoven comprises fibers having a diameter between 0.1 and 1 μm, and especially between 0.1 and 0.5 μm, and also fibers having a diameter between 30 and 40 μm.

Preferably, all fibers in the nonwoven have diameters in the range of 0.05 to 60 μm, more preferably in the range of 0.1 to 50 μm. In general, it is preferred that the nonwoven does not comprise fibers having a diameter larger than 60 μm or larger than 50 μm.

In a preferred embodiment, the maximum fiber diameter is in the range of between 20 μm to 60 μm. Overall, when the nonwoven comprises such a mixture of relatively thin and thick fibers, an advantageous combination of mechanical stability and good barrier function is obtainable.

A nonwoven fabric produced by thermal bonding of the nonwoven as described above has advantageous properties for packaging applications, especially for sterile medical packaging. Specifically, it was found that the nonwoven fabrics have a low pore size and a relatively narrow pore size distribution. Preferably, the absolute pore sizes of the nonwoven fabric are larger than 0.5 μm, preferably at least 1 μm. Preferably, the pore sizes are not larger than 20 μm, more preferably not larger than 15 μm. In a preferred embodiment, the pore sizes of the nonwoven fabric are between 0.5 and 20 μm, more preferably between 1 μm and 15 μm. This means that more than 99.5% of the pores, or even more than 99.9% of the pores, or essentially all pores in a nonwoven fabric have a size as defined above. Preferably, the pore sizes are determined by ASTM E1294 (1989). In a preferred embodiment, the average pore size of the nonwoven fabric is between 2 μm and 10 μm. More preferably, the average pore size of the nonwoven fabric is between 3 and 8 μm. Preferably, the standard deviation of the pore size from the average pore size is less than 400%, more preferably less than 200%. The relatively low pore sizes of the nonwoven fabrics render them applicable for sterile packaging applications. Generally, it is acknowledged in the art that a maximum pore size of less than 35 μm is required for such applications.

The nonwoven and nonwoven fabric used for producing the packaging of the present invention comprises meltblown polymer fibers. In a preferred embodiment, all the polymer fibers of the nonwoven and nonwoven fabric are meltblown polymer fibers. It is highly preferred that the nonwoven is produced in a single meltblowing process. Preferably, the nonwoven and nonwoven fabric do not comprise other fibers, which are not meltblown. However, it is also possible to produce the nonwoven in a method in which polymer fibers are meltblown, and other fibers, such as spunlaid fibers or staple fibers, are added and mingled with the meltblown fibers. In such an embodiment, it is preferred that the amount of meltblown polymer fibers in the nonwoven is relatively high, for example more than 50% or more than 80% by weight of all fibers.

In principle, any synthetic polymers can be used for producing the nonwoven by meltblowing, which are applicable for meltblown processes known in the art. Typically, the polymers are thermoplastic polymers which can be extruded. Preferred polymers are polyolefins, such as polyethylene or polypropylene, polyesters and copolyesters, such as polyethylene terephthalate, polybutylene terephthalate, polycarbonate or polylactate, polyamides, such as polyamide 6 or polyamide 6,6, halogenated polymers, such as polyvinylidenchloride, or (meth)acrylates, such as polymethylmethacrylate. Mixtures or copolymers of such compounds can also be used.

In a preferred embodiment, the fibers comprise at least one polymer selected from polyethylene and polyesters. These materials are especially applicable for sterile packaging applications, because they are sufficiently stable for sterilization with γ-radiation and/or at relatively high temperatures. The polyethylene can be high-density or low-density polyethylene. Amongst polyesters, it is especially preferred to use polybutylene terephthalate or polyethylene terephthalate.

For high stability and sterilization, it is preferred that the melting temperature of the polymer, more preferably of all polymers in the nonwoven, is relatively high. Preferably, the melting temperature is above 160° C., more preferably above 180° C. or above 200° C. Such a melting temperature is also advantageous for sealing the packaging, for example by thermally adhering to sections of the nonwoven fabric which are adhered to each other. Alternatively, the nonwoven fabric can be sealed to another material.

According to the invention, the nonwoven is produced in a meltblow process in a manner such that a relatively broad fiber diameter distribution is obtained. In a conventional standard meltblow process, very fine fiber diameters in the range of 1 μm to 5 μm can be obtained. However, the fiber diameter distribution obtained in such a conventional process is rather narrow. The standard deviation of the fiber diameter is significantly below 100%, often in the range of about 50%. Such materials consist predominantly of fine fibers and lack sufficient mechanical strength which is required for sterile packaging applications.

Methods are known in the art how to modify a meltblow process, such that a broader fiber diameter distribution is obtained. For example, this can achieved by adjusting the air streams, which take up the emerging polymer fibers, such that they are subjected to higher turbulence and strongly swirled. Alternatively, different fiber diameters can be obtained by simultaneous spinning of fibers with different diameters from different spinning devices into a single nonwoven.

In a preferred embodiment, meltblowing is carried out in a concentric air meltblowing process. As used herein, this term refers to a meltblowing process, in which multiple rows of spinning dies are used, each of which are surrounded by air nozzles. As described in the art, a relatively broad fiber distribution can be obtained accordingly.

In a preferred embodiment, meltblowing is carried out in a multi row meltblowing process. As described in the art, the fiber diameter distribution can be enhanced in such a multi-row meltblow process, in which a large number of spinning dies are extruded in parallel.

In a highly preferred embodiment, meltblowing is carried out in a concentric air multi row meltblowing process. In this embodiment, a concentric air meltblow method is carried out as a multirow process. Such a method is especially suited for obtaining a broad fiber diameter distribution. In a less preferred embodiment, a concentric air single row meltblowing process may be applied.

A concentric air multi row meltblowing process is typically carried out as follows. The molten polymer and hot air are fed in parallel through a spinneret through an array of multiple dies and nozzles. The emerging polymer fibers are surrounded by concentric nozzles from which hot air is blown. After exit from such die openings, the molten polymer is immediately stretched by hot air from the surrounding nozzle. The overall system creates a high turbulence, such that sections of the fibers are formed having small and large fiber diameters. The fibers are blown onto a collector and swirled. The collector may comprise suction means. The fibers are accumulated on the collector surface to obtain a nonwoven web, which can subsequently be converted into a nonwoven fabric by thermal bonding, if desired. Such multi-row meltblow systems with concentric air nozzles are described in US 2017/0211216 A1, WO 2015/171707 A1, US 2017/152616 A1 or US 2015/211160 A1. Devices for carrying out such methods are commercially available from Biax-Fiberfilm, U.S., under the trademark Spunblow.

Alternatively or in addition, multiple (i. e. two, three or more) multi row meltblowing devices can be arranged in parallel for spinning different polymer fibers into the same nonwoven. In such a process, all polymer fibers, which are spun from different devices, are mixed in the process and laid down simultaneously on a single conveyor belt. A nonwoven is obtained comprising the different fibers, which is preferably homogenous. In contrast, the different fibers are not laid down consecutively, such as a laminate would be formed. The fiber diameter distribution can be increased by combining of two or more meltblowing devices, which produce different polymer fibers. When two multi-row spinnerets are arranged at a specific angle, the polymer fibers are blown onto a collector to produce hybrid nonwoven webs of two different fiber types which are strongly intermingled. Preferably, all devices use a concentric air multi row meltblowing process for spinning the different fibers. Such methods are known in the prior art and described, for example, in US 2015/0322602 A1 or US 2017/137970 A1. Various process modifications are known and described in the art for adjusting the composition and properties of the nonwovens. Each spinneret can be fed by an independent extruder, or both spinnerets can be fed from a single extruder. With independent extruders, two different polymers can be spun onto the collector to produce hybrid nonwoven webs. For example, a polymer having a low melting point can be combined with another polymer having a higher melting point, such as polyethylene and polyester. When polyethylene and polyester are combined and calendered, polyethylene can be molten at least in part to adhere the polyester fibers to each other; resulting in a high strength of the nonwoven fabric and a small pore size. It is also possible to combine relatively fine fibers meltblown from a first spinneret with relatively coarse fibers spunlaid from a second spinneret. Such a method can be used for obtaining a high fiber diameter variation. Moreover, polymer materials can be combined, which confer specific properties to the nonwoven, for example by combining polymers having a different meltflow index. For example, a first meltblown polymer could have a meltflow index of 600 or less, whereas a second polymer could have a meltflow index of 600 or higher. The higher the meltflow index is, the lower the melt viscosity is. Thus, finer fibers are produced from the polymer which is meltblown having a higher meltflow index, whereas thicker fibers are obtained from the polymer having a lower meltflow index.

The nonwoven can also be obtained by other production processes, in which two different fiber types are spun in parallel and combined in the same spinning process. For example when a concentric air multi-row meltblowing process is carried out in parallel with a second spinning process, a mixed nonwoven of intermingled fibers can be obtained on a single deposit. For example, a concentric air multi-two meltblowing process can be combined with a conventional meltblowing process, when two spinnerets are applied in parallel for producing polymer fibers. For example, such a method can be adjusted such that relatively fine fibers are added to the emerging nonwoven from the conventional meltblowing process, whereas fibers having a higher diameter are added from the concentric air multi-row meltblowing process.

In a preferred embodiment, the nonwoven is prepared in a single meltblowing process from two, three or more different types of polymers, which yield two, three or more different types of polymer fibers (most preferably two). Thereby, a nonwoven is obtained comprising two or more different fibers having different structure, polymer composition and/or functional properties. For example, different polymer fibers can be combined by meltblowing from different spinnerets, or from a single spinneret with different feed lines. According to the invention, it is preferred that the meltblown nonwoven comprises at least two different meltblown polymer fibers. In a preferred embodiment, the two polymers are different polyesters. In another preferred embodiment, the different polymers are polyethylene and a polyester. In such nonwovens, advantageous properties of two polymers can be combined. Further, it is advantageous that different materials having different fiber properties can be combined in a single nonwoven, for example a first polymer fiber having a first fiber length and a second polymer fiber having a second fiber length. It is also possible to combine a fiber with a relatively low melting point, such as polyethylene, with a fiber of relatively high mechanical stability, such as polyester fiber.

The nonwoven sheet may be produced by two or more beams in a single meltblow process with the following combinations:

- both meltblow beams are multi-row concentric air with identical or different polymer in each of the beams, or
- one of the meltblow beams is single row capillary meltblow and the other being multi-row concentric air meltblow with identical or different polymer in each of the beams.

The meltblown nonwoven is thermally bonded to obtain a nonwoven fabric. As known in the art, such thermal bonding can be carried out in a manner such that the basic fiber structure of the nonwoven is maintained at least in part. Thus, heat is applied to an extent that the fibers may not be completely molten, but only softened, such that binding sites are created throughout the nonwoven fabric. Preferably, the basic nonwoven structure is maintained in the thermal bonding step at least in portions of the nonwoven fabric, especially in the interior.

In a preferred embodiment, the thermal bonding is carried out by calendering. In this standard method, a nonwoven is passed through a pair of calender rolls, which are typically heated. The conditions of the calendering step are adjusted such that only a partial melting of fibers occurs, such that the nonwoven is thermally bonded to a desired extent. The amount of bonding and bonding strength can be adjusted for example by modifying the speed of the calender rolls, the pressure applied, the distance between the roller nips and the temperature applied. Thereby, it is possible to obtain a degree of thermal bonding such that a desired mechanical strength is obtained, whereby the basic fiber structure, especially in the core of the nonwoven, can essentially be maintained, or at least maintained to a desired degree. For example, the nonwoven fabric can be calendered using a pair of calendar rollers having any one of the following properties:

- a speed of the rollers between 1 and 200 m/min, preferably between 50 and 180 m/min,
- a pressure on the rollers between 5 and 200 bar, preferably between 10 and 100 bar,
- a distance between the roller nips between 0.01 mm and 5 mm, preferably between 0.05 mm and 3 mm,
- a temperature of the rollers between 10° C. and 400° C., preferably between 150° C. and 280° C.

Calendering can be carried out over the total surface of the nonwoven, or parts thereof, when the roller surface is patterned. According to the invention, calendering is preferred for thermal bonding, because the mechanical strength of the nonwoven fabric can be increased, whilst the fiber structure of the nonwoven can essentially be maintained.

The nonwoven fabric is not a laminate. Preferably, it is also not a layer of a laminate. Therefore, it is preferred that the packaging does not comprise a laminated nonwoven structure. According to the invention, it was found that a sterile packaging is obtainable from a single nonwoven layer of fibers having a relatively low fiber diameter and relatively high broad fiber diameter distribution. The nonwoven fabric obtained from such a nonwoven by thermal bonding is already an efficient packaging material when used in a single layer. This is highly advantageous, because the problem of delamination does not occur. In contrast, standard packagings, such as SMS nonwovens or flashspun porous sheets, are provided in the form of laminates. Delamination of these packaging materials can occur during the production process, but also during packing, transport or storage. Such a delamination is highly problematic, because it can lead to contamination of the packed objects. Moreover, the nonwoven fabric of the present invention can be produced in simple single step meltblow and thermal bonding process. This is highly advantageous, because production of conventional laminates from two or more materials requires several additional process steps. Such a process is not only more complex and less efficient, but also more prone to errors, which requires far more control in sterile applications. In a specific embodiment, the single layer nonwoven is homogeneous. This means that there are no macroscopic variations regarding the fiber sizes, fiber types or the like throughout the interior.

In a specific embodiment, the fiber size distribution, when determined in μm steps, comprises a single peak. Alternatively, it may comprise two or more peaks. A structure with two or more peaks can be obtained when combining polymer fibers having two or more significantly different fiber diameters in a single meltblowing process, for example by spinning from dies having different diameters.

In a preferred embodiment, the packaging is sterile. This means that it has been sterilized with a standard sterilization method. Typically, the object is packed in the packaging before sterilization into a packed article. The article is preferably sealed, such that the object cannot be contaminated after sterilization without breaking the packaging.

Sterilization can be carried out by known methods. Typically, packed objects are sterilized by at least one of high energy radiation, especially γ-radiation, by heat, under pressure, by steam, especially in an autoclave, or by reactive chemicals, such as ethylene oxide.

In a preferred embodiment, the packaging is sterilized by γ-radiation (gamma-radiation). This process is also known as γ-ray sterilization. Gamma-rays are highly energetic and are known to chemically modify or destroy substrates of low mechanical strength. However, the packaging of the invention can be provided with a high mechanical strength, such that it can be subjected to efficient sterilization by γ-rays.

In a preferred embodiment, the packaging is a medical packaging. The term "medical packaging" refers to any sterile packaging required specifically in the technical field of pharmaceutical and health care. For example, a medical packaging may comprise a packed object, which is a pharmaceutical composition, such as a drug or liquid, or a medical device, such as a catheter, syringe, wound dressing or the like. In medical packaging, there is a high demand for safe and cost-efficient sterile packaging material, because basically all relevant equipment and pharmaceutical compositions have to be provided and maintained in sterile form. Further, there is a high need for lightweight, simple packagings in the medical field. The packaging of the invention is highly suitable for meeting such demands, because it combines various advantageous properties, which are high mechanical strength, high barrier function due to low porosity, good air permeability, light weight and relatively simple production, without the need for reinforcement or lamination in downstream processing steps. Specifically, the material is strong enough for standard sterilization by γ-ray, steam or chemicals.

In a preferred embodiment, the areal weight (base weight) of the nonwoven fabric is between 10 $g/m^2$ and 200 $g/m^2$. More preferably, the base weight is between 20 and 140 $g/m^2$, even more preferably between 50 $g/m^2$ and 120 $g/m^2$. Preferable, the base weight is not higher than 200 $g/m^2$, or preferably not higher than 140 $g/m^2$, and especially preferred not higher than 120 $g/m^2$ or even 100 $g/m^2$. Preferably, the base weight is at least 10 $g/m^2$, or at least 20 $g/m^2$, or in a specific embodiment at least 50 $g/m^2$. Preferably, the areal weight is measured according to DIN ISO 9073-1 (1989). The base weight is adjusted such that the packaging has a required mechanical strength and barrier function. It was found that the nonwoven fabrics, which have a relatively broad fiber diameter distribution, are applicable at relatively low areal weights. This is highly advantageous in packaging applications for saving material and costs during production, but also transport. Further, a significant amount of waste can be avoided in the health care sector, for example when packing disposable items such as syringes or wound dressings.

In a preferred embodiment, the tear strength of the nonwoven fabric in the machine direction and cross direction is at least 300 mN. More preferably, the tear strength is at least 500 mN or at least 1,000 mN. The tear strength can be in the range of 300 to 5,000 mN, especially in the range of 1,000 to 5,000 mN. Preferably, tear strength is determined according to EN 21974 (1994). According to the invention, it was found that the nonwoven fabrics have very high mechanical stability, as indicated by the tear strength, at relatively low base weights. This renders them especially appropriate for sterilization under harsh conditions, especially with γ-radiation, but also to meet standard stability requirements for handling, including transportation, packing and the like.

In a preferred embodiment, the tensile strength of the nonwoven fabric in the machine direction and cross direction is at least 200 N/5 cm. Preferably, the tensile strength is at least 250 N/5 cm, more preferably at least 300 n/5 cm. Preferably, the tensile strength is in the range of 200 N/5 cm to 600 N/5 cm, and specifically in the range of 250 N/5 cm to 500 N/5 cm. Preferably, tensile strength is determined according to ISO 1924-2 (2009). Also the tensile strength is indicative of suitability as packaging, especially medical sterile packaging. The high tensile strength indicates that the material is suitable for sterilization and typical packaging applications.

In a preferred embodiment, the elongation of the nonwoven fabric in the machine direction and cross direction is at least 5%. Preferably, elongation is at least 10%, more preferably at least 20%. Preferably, elongation is in the range of 5% to 50%, more preferably between 10% to 40%, most preferably between 20% and 30%. Preferably, elongation is determined by ISO 1924-2 (2009). Such a high elongation is advantageous, because the nonwoven fabric has sufficient flexibility and elasticity required for standard packaging applications. The flexibility confers additional stability to the packaging material and reduces the risk of damages. According to the invention, it is especially advantageous that the high flexibility can be achieved, although mechanical strength is high and although the air permeability is high. In the prior art, for example with flash-spun porous sheets for medical applications, it is difficult to combine high air permeability with high mechanical strength and flexibility. Typically, porous sheets used in the prior art have a relatively low flexibility as indicated by elongation.

In a preferred embodiment, the bacterial filtration efficiency (BFE) of the nonwoven fabric is at least 80%. Preferably, the bacterial filtration efficiency is at least 90%, more preferably 95% or at least 99%. Preferably, the barrier to bacteria Log Reduction Value (LRV) of the nonwoven fabric is more than 1. Preferably, the LRV is more than 2, more preferably more than 3, and even more preferably more than 5. For sterile packaging applications, especially in the medical field, it is important that a packaging material provides an efficient barrier against germs, such as bacteria or other microorganisms, such as viruses, in order to keep the sealed object sterile for an extended time period. Germs, especially bacteria, must not be able to penetrate the packaging and contaminate the packet object after sterilization. Bacterial log reduction value (LRV) and bacteria filtration efficiency (BFE) are standard parameters for determining bacterial barrier properties in accordance with ASTM F1608 (2016). LRV is indicative of the relative number of live microbes eliminated from a surface by cleaning. For example, a LRV of 3 reduction means lowering the number of microorganisms by a factor of 1,000 or by 99.9%. Thus, high LRV rates correspond to higher bacterial barrier properties. In contrast, BFE is expressed in percentage of bacteria which are stopped by the nonwoven fabric. For a sterile packaging product, it is desirable to have a BFE of at least 85%.

Preferably, the burst strength of the nonwoven fabric is at least 200 kPa, preferably at least 500 kPa, more preferably at least 700 kPa. The burst strength of the nonwoven fabric may be below 2000 kPa or below 1200 kPa. Preferably, the burst strength is in the range of 200 kPa to 2000 kPa, more preferably 300 kPa to 1200 kPa or 500 kPa to 1200 kPa. It was found that the inventive packagings have a high burst strength. Burst strength is indicative of mechanical stability of a nonwoven sheet under pressure. A high burst strength is required for sterilization applications under vacuum. In sterilization applications, a packaging can be subjected to pressure during injection of sterilization gases, followed by removal of the gases. The high burst strength of the inventive nonwoven fabric indicates that it is suitable for such standard sterilization procedures.

In a preferred embodiment, the air permeability of the nonwoven fabric is at least 200 mL/min. More preferably, the air permeability is at least 300 ml/min, most preferably at least 400 ml/min. Specifically, the air permeability is in the range of 200 ml/min to 1,000 ml/min, or specifically in the range of 300 ml/min to 800 ml/min. Preferably, air permeability is determined according to ISO 5636-3 (2013; Bendtsen-Test). High air permeability is especially required for standard sterilization procedures, in which a packaging is sterilized with gaseous chemicals or steam. In such a process, for example with ethylene oxide, the package is sealed and the packed object is subjected to a sterilization treatment in which the sterilization agent penetrates the packaging. It was found that the nonwoven fabric used according to the invention has sufficient permeability for such sterilization procedures.

Preferably, the nonwoven fabric has a delamination value of at least 1 N/2.5 cm, more preferable at least 2 N/2.5 cm or 10 N/2.5 cm. This means that a relatively high force is required for delamination. Preferably, delamination is determined according to ASTM D2724 (2015).

In a preferred embodiment, the nonwoven fabric is printable. Therefore, it can be marked with labels, tags or the like in a simple printing process.

In a preferred embodiment, the packaging is stable at relatively high temperatures. Preferably, the packaging is stable at temperatures of up to 160° C., more preferably up to 200° C., or even up to 220° C. This means that the structure is not essentially disrupted, and the polymers are not molten at such a temperature. Such thermostable nonwoven fabrics can be sterilized at high temperature, with is highly advantageous for various sterilization applications.

Subject of the invention is also a packed article, comprising a packed object, which is packed in a packaging as described herein. Subject of the invention is also the use of a packaging as described herein for packing an object. Preferably, the object is a medical object and the packaging is a medical packaging. Preferably, the object is a cosmetic object and the packaging is a cosmetic packaging. Preferably, the article is a sterile article and the packaging is a sterile packaging.

In principle, the inventive packaging is applicable for packing any object, especially a medical object, which is packed with the packaging and subsequently sterilized. The packed medical object can be a composition or a device. For example, the composition could be a pharmaceutical composition, such as a drug, or any other solid or liquid agent or composition used in the medical field. The device could be a disposable, such as a syringe or wound dressing. Preferably, the medical object is used in a medical treatment, such as therapy, diagnostics or surgery.

Subject of the invention is also a method for providing a packed object, comprising (a) providing the object and a packaging as described herein, (b) packing the object in the packaging, and (c) optionally sterilizing the packed object.

The method is also a method for providing a packed article. Preferably, the packed object is a medical object as described above. The method is also a method for sterilizing a packed object or a packed article, if step (c) is applied. Preferably, the packing in step (b) is carried out such that the object is sealed, i.e. that it is completely shielded from the environment by the packaging.

In a preferred embodiment, the method comprises before step (a) the steps of (a1) producing the nonwoven in a meltblow process and (a2) thermally bonding the nonwoven to obtain the nonwoven fabric.

After step (a2), the nonwoven fabric may be converted into the packaging by additional steps, for example by adding a label. In a preferred embodiment, steps (a1) to (b), and optionally with additional step (c), are carried out consecutively in a single process. Alternatively, a nonwoven fabric can be obtained according to steps (a1) and (a2), whereas packing of an object is carried out separately, for example by a supplier of medical articles.

The inventive packagings, uses and methods solve the problem underlying the invention. The packaging is applicable for sterile packing of objects, such as medical articles. The packaging has a high mechanical strength and a high barrier function against germs, such as bacteria or viruses. The packaging has sufficient stability to be applied to standard sterilization processes, such as γ-radiation, high temperature treatment or chemical sterilization. It has sufficient porosity for sterilization treatment with chemicals. Its mechanical strength and high elasticity are highly advantageous for standard packaging procedures and applications. All the advantageous properties can be achieved with a product having a relatively low base weight. Overall, the invention provides novel and highly advantageous materials for simple and efficient packaging of objects.

EXAMPLES

Meltblown nonwoven sheets were produced in concentric air multi row meltblowing processes as described in the following.

Example 1

First and second polymers were melted in an extruder and the respective molten polymer streams were directed separately through the spinnerets. The first polymer is a polyester (polyethylene terephthalate, trademark 14965; Eastman, US) and the second polymer is a co-polyester (co-polyethylene terephthalate, trademark Advanite 53001; SASA, TR). The viscous polymeric solution was then blown using hot primary air at a temperature of 350° C. for the beam containing polyester and 250° C. for the co-polyester beam. The resulting meltblown nonwoven web had an intermingled fibrous structure each comprised about 50%, by volume, of the fiber. The collected web is then transferred on to a pair of calendar rollers having plain metal-metal configuration. The nonwoven web is then transformed into a nonwoven sheet provided the calendar roller temperature at 200° C. at a roller over roller pressure of 40 bar. This action makes the co-polyester to melt and bond with that of polyester resulting in a thin sheet. The resulting 75 g/m$^2$ nonwoven fabric had a pore size between 2 μm and 9 μm and a tensile strength of 300N/5 cm.

Example 2

First and second polymers were melted in an extruder and the respective molten polymer streams were directed separately through the spinnerets. The first polymer is a polyester (polyethylene terephthalate, trademark 14965; Eastman, US) and the second polymer is a high density polyethylene (trademark 6831A; DOW Chemicals, US). The viscous polymeric solution was then blown using hot primary air at a temperature of 350° C. for the beam containing polyester and 200° C. for the polyethylene beam. The resulting meltblown nonwoven web had an intermingled fibrous structure each comprised about 50%, by volume, of the fiber. The collected web is then transferred on to a pair of calendar rollers having plain metal-metal configuration. The nonwoven web is then transformed into a nonwoven sheet provided the calendar roller temperature at 160° C. at a roller over roller pressure of 40 bar. This action makes the polyethylene to melt and bond with that of polyester resulting in a thin sheet. The resulting 85 g/m$^2$ nonwoven fabric had a pore size between 3 μm and 12 μm and a tensile strength of 320N/5 cm.

Example 3

First and second polymers were melted in an extruder and the respective molten polymer streams were directed separately through the spinnerets. The first polymer is a polyester (polyethylene terephthalate, trademark 14965; Eastman, US) and the second polymer is a polybutylene terephthalate (trademark Vestodur 1000; Evonik, DE). The viscous polymeric solution was then blown using hot primary air at a temperature of 350° C. for the beam containing polyester and 250° C. for the polyethylene beam. The resulting meltblown nonwoven web had an intermingled fibrous structure each comprised about 50%, by volume, of the fiber. The collected web is then transferred on to a pair of calendar rollers having plain metal-metal configuration. The nonwoven web is then transformed into a nonwoven sheet provided the calendar roller temperature at 250° C. at a roller over roller pressure of 50 bar. This action makes the polyethylene to melt and bond with that of polyester resulting in a thin sheet. The resulting 80 g/m$^2$ nonwoven fabric had a pore size between 2 μm and 10 μm and a tensile strength of 370N/5 cm.

Example 4

First and second polymers were melted in an extruder and the respective molten polymer streams were directed separately through the spinnerets. The first polymer is a polyester (polyethylene terephthalate, trademark RT 5520; Invista, US) and the second polymer is a co-polyethylene terephthalate (trademark CS113; Far Eastern New Century, CN). The viscous polymeric solution was then blown using hot primary air at a temperature of 350° C. for the beam containing polyester and 250° C. for the co-polyester beam. The resulting meltblown nonwoven web had an intermingled fibrous structure each comprised about 50%, by volume, of the fiber. The collected web is then transferred on to a pair of calendar rollers having plain metal-metal configuration. The nonwoven web is then transformed into a nonwoven sheet provided the calendar roller temperature at 220° C. at a roller over roller pressure of 40 bar. This action makes the co-polyester to melt and bond with that of polyester resulting in a thin sheet. The resulting 75 g/m$^2$ nonwoven fabric had a pore size between 2 μm and 9 μm and a tensile strength of 300N/5 cm.

Example 5

First and second polymers were melted in an extruder and the respective molten polymer streams were directed separately through the spinnerets. The first polymer is (polybutylene terephthalate, trademark Celenax 1300A; Ticona, US) and the second polymer is a co-polyethylene terephthalate (trademark CS113; Far Eastern New Century, CN). The viscous polymeric solution was then blown using hot primary air at a temperature of 300° C. for the beam containing PBT and 220° C. for the co-polyester beam. The resulting meltblown nonwoven web had an intermingled fibrous structure each comprised about 50%, by volume, of the fiber. The collected web is then transferred on to a pair of calendar rollers having plain metal-metal configuration. The nonwoven web is then transformed into a nonwoven sheet provided the calendar roller temperature at 190° C. at a roller over roller pressure of 40 bar. This action makes the co-polyester to melt and bond with that of polyester resulting in a thin sheet. The resulting 85 g/m$^2$ nonwoven fabric had a pore size between 1 μm and 9 μm and a tensile strength of 340N/5 cm.

Example 6: Properties of Nonwoven Fabrics

Properties of the nonwovens and nonwoven sheets obtained according to examples 1 to 5 were determined. The following methods were used.

Fiber diameter and fiber diameter standard deviation of a nonwoven were determined from electron microscope images. Nonwoven webs are cut and placed onto a carbon tape fixed onto a metal stub, which then was gold sputter coated. The sputter coated sample stubs are then analyzed with scanning electron microscope (SEM) and pictures obtained. The pictures were then fed into standard software (Image Access V12, Image Bildverarbeitung AG, CH) to measure the fiber diameters manually. Statistical plots (average, standard deviation and CV %) were then made with standard Microsoft Excel worksheet.

Areal weight is defined as the mass per unit area and is measured in grams per square meter (g/m$^2$). Areal weight of nonwoven fabrics is measured using the norm ISO 9073-1 (1989).

Pore size measurements of nonwoven fabrics were carried out with a Porous Materials Inc. (PMI) tester (Porous Materials Inc., US). ASTM E 1294 (1989) standard was followed for pore size measurements of sterile packaging product. Pore size measurements were based on displacement of wetting liquid with low surface tension (trademark GALDEN HT 230; Solvay, IT) from a pore by a gas.

Tensile strength (breaking strength) and elongation of nonwoven fabrics were measured using tensile strength testing machine using ISO 1924-2 (2009) standard. To measure tensile strength and elongation of the nonwoven material, five strips from both machine and cross direction (MD&CD) were cut at different locations of the sample. The cut samples were clamped on to the jays of the tensile testing machine and drawn at a constant rate of extension. Tensile strength and elongation was then recorded for each sample and averaged.

Air permeability of nonwoven fabrics was measured according to the standard ISO 5636-3 (2013; Bendtsen test).

Tear strength of nonwoven fabrics was determined according to European Standard EN21974 (1994).

Burst strength of nonwoven fabrics was measured using burst tester using ISO 2758 norm (2014).

Barrier Log Reduction Value (LRV; or Bacterial Filtration Efficiency, BFE) is a measure of the bacterial barrier properties of a material or sheet and was tested with nonwoven fabrics in accordance with the norm ASTM F 1608 (2016).

The results are summarized in table 1 below.

TABLE 1

Properties of nonwovens and nonwoven fabrics of examples 1 to 5

| Example | | 1 | 2 | 3 | 4 | 5 |
|---|---|---|---|---|---|---|
| Fiber Diameter (μm) | Average | 4.5 | 5.2 | 4 | 3.8 | 4.5 |
| | Standard Deviation μm | 8.4 | 9.2 | 8.1 | 7.7 | 8.8 |
| | Standard Deviation % | 186 | 176 | 202 | 202 | 195 |
| | Min | 0.11 | 0.15 | 0.12 | 0.1 | 0.11 |
| | Max | 46.6 | 48.9 | 40.4 | 42.4 | 48.4 |

TABLE 1-continued

Properties of nonwovens and nonwoven fabrics of examples 1 to 5

| Example | | 1 | 2 | 3 | 4 | 5 |
|---|---|---|---|---|---|---|
| Areal Weight (g/m$^2$) | | 75 | 85 | 80 | 75 | 85 |
| Pore | Min | 2 | 3 | 2 | 2 | 1 |
| Size (μm) | Max | 9 | 12 | 10 | 9 | 9 |
| Tensile Strength (N/5 cm) | | 300 | 320 | 370 | 300 | 340 |
| Elongation (%) | | 24.3 | 20.7 | 25.2 | 20.8 | 20.6 |
| Air Permeability (mL/min) | | 540 | 560 | 571 | 536 | 321 |
| Tear Strength (mN) | | 3291 | 2980 | 3202 | 3603 | 2757 |
| Burst Strength (kPa) | | 1138 | 1034 | 1186 | 1048 | 1020 |

The results demonstrate that the nonwovens produced according to the concentric multi-row meltblowing process have broad fiber diameter distributions. The standard deviation is between 176% and 202%, whereas fiber size diameters range from 0.1 μm to about 50 μm. The areal weight of the nonwoven fabrics is between 75 g/m2 and 85 g/m2 and thus relatively low. However, the mechanical strength is relatively high, as indicated by tensile strength, tear strength and burst strength. The tear strength is above 300 nm, and thus the risk of damage in packaging applications, for example by piercing or tearing, is relatively low. The burst strength is above 200 kPa, which indicates that the sheet is burst-resistant in standard sterilization methods, wherein packaging materials are subject to pressure during injection of sterilization gases under high vacuum, followed by removal of the gases. The tensile strength is above 250 N/cm, which is required for sterile packaging applications. However, the elongation is about 20% to about 25% and thus relatively high, such that the packing materials is suitable for standard packing applications.

A prerequisite for sterilization of packing materials with sterilization agents is high air permeability. The results indicate that the air permeability of the materials is sufficiently high for such sterilization treatments.

For sterile packaging, it is extremely important that the pore sizes of the materials are small and also uniform. A standard norm value for sterile packaging products requires that all pore sizes are less than 35 μm. The results shown indicate that all pore sizes of the nonwoven fabrics are small, typically in the range of 1 to 12 μm. Therefore, the materials are highly suitable for preventing contamination by bacteria or other germs.

Overall, the results demonstrate that the nonwoven fabrics are highly suitable for sterile packaging applications. They combine a high mechanical strength with a low areal weight, high air permeability and low and uniform pore size distribution. Thus, they are applicable as cost-efficient, robust and highly sterile packaging products. The production process is simple and efficient and does not require lamination steps or other complex post-treatment steps of the meltblown nonwovens.

Nonwoven fabrics were also examined by scanning electron microscopy (SEM). FIG. 1 shows an image of a nonwoven fabric produced according to example 2. On the surface, the fibers are in part adhered to each other in the calendering treatment. However, in the interior of the nonwoven fabric, the fibers from the meltblowing process have essentially preserved their shape and structure. It can be seen that the nonwoven fabric interior consists of closely intermingled fine and coarse fibers.

Figure 2:
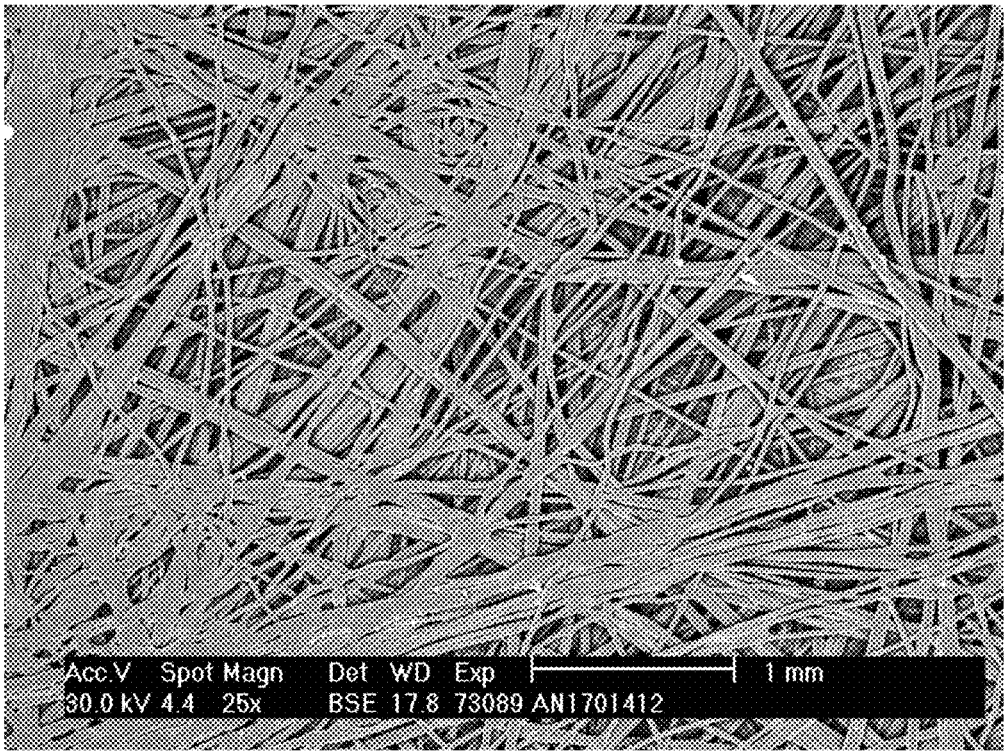
Figure 3:
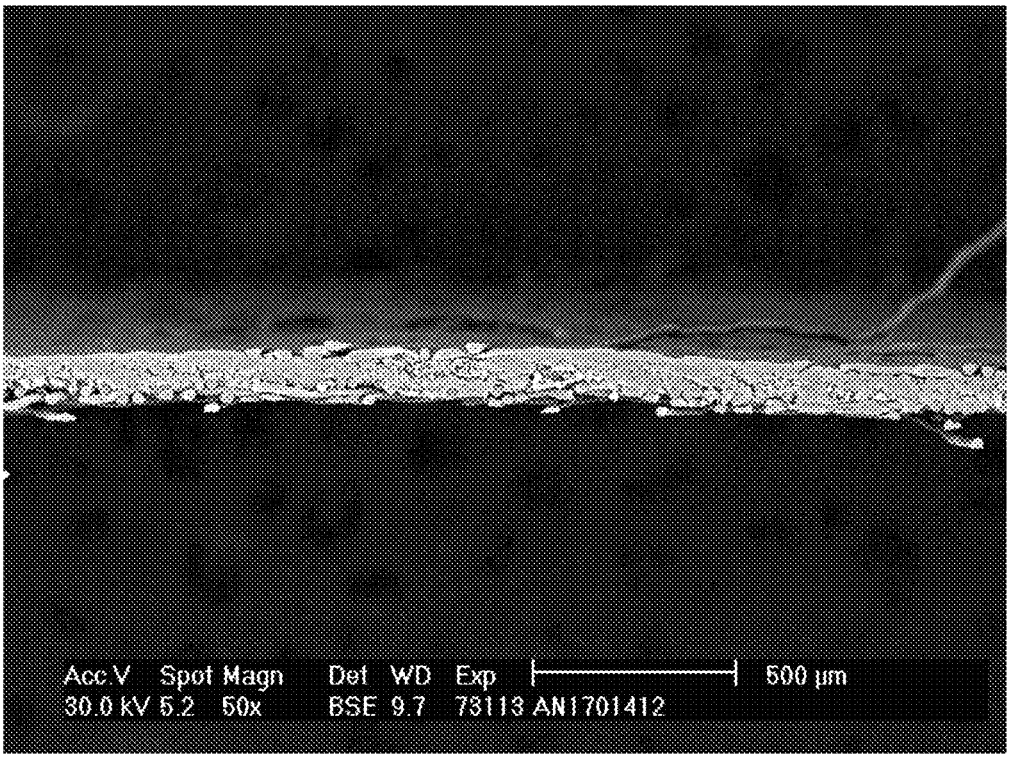

FIG. 2 shows another SEM image of a nonwoven fabric applicable according to the invention comprising fibers of high and low diameter. In FIG. 2, sections of very fine fibers are visible from a top view. FIG. 3 is a cross-section of the nonwoven fabric of FIG. 2. It can be seen that areas with fibers having a low diameter are intermingled with fibers having a high diameter. Without being bound to theory, it is assumed that the larger fibers reinforce the overall structure and confer high mechanical stability to the nonwoven fabric, whereas the fine fibers provide a barrier function.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A packaging for sterile packaging application, comprising:

a single layer nonwoven fabric obtained from a nonwoven comprising meltblown polymer fibers having an average fiber diameter between 2 μm to 10 μm and a standard deviation of the average fiber diameter of at least 100%, wherein the nonwoven is thermally bonded.

2. The packaging according to claim 1, wherein the average fiber diameter is between 3 to 7 μm.

3. The packaging according to claim 1, wherein the standard deviation of the fiber diameter from the average fiber diameter is at least 150%.

4. The packaging according to claim 1, wherein pore sizes of the nonwoven fabric are between 0.5 and 20 μm and/or wherein an average pore size of the nonwoven fabric is between 2 μm and 10 μm.

5. The packaging according to claim 1, wherein the fibers comprise at least one polymer selected from the group consisting of polyethylene and polyesters.

6. The packaging according to claim 1, wherein melt-blowing is carried out in a concentric air multi row melt-blowing process.

7. The packaging according to claim 1, wherein the thermal bonding is carried out by calendering.

8. The packaging according to claim 1, wherein the packaging is sterile, and wherein the packaging is sterilized by γ-radiation.

9. The packaging according to claim 1, wherein the packaging comprises a medical packaging.

10. The packaging according to claim 1, wherein the nonwoven fabric has at least one of the following properties:

an areal weight between 10 $g/m^2$ and 140 $g/m^2$, a tear strength in a machine direction and cross direction of at least 300 mN, a tensile strength in the machine direction and cross direction of at least 200 N/5 cm, an elongation in the machine direction and cross direction of at least 5%, an air permeability of at least 200 mL/min, a bacterial filtration efficiency (BFE) of at least 80%, and/or a barrier to bacteria Log Reduction Value (LRV) of more than 1.

11. A packed article, comprising a packed object, which is packed in the packaging according to claim 1.

12. A method of using the packaging according to claim 1, comprising:

packaging an object.

13. A method for providing a packed article, comprising:

(a) providing an object and a packaging according to claim 1;

(b) packing the object in the packaging to obtain the packed article; and (c) optionally sterilizing the packed object.

14. The method of claim 13, further comprising:

before step (a), the steps of (a1) producing the nonwoven in a meltblow process; and (a2) thermally bonding the nonwoven to obtain the nonwoven fabric.

15. The packed article of claim 11, wherein the article comprises a medical article, and/or wherein the object comprises a medical object.

16. The method of claim 12, wherein the article comprises a medical article, and/or wherein the object comprises a medical object.

17. The method of claim 13, wherein the article comprises a medical article, and/or wherein the object comprises a medical object.

18. The method of claim 14, wherein the article comprises a medical article, and/or wherein the object comprises a medical object.

19. The packed article of claim 11, wherein the article comprises a medical article, and wherein the medical article comprises a sterile medical article.

20. The packed article of claim 11, wherein the object comprises a medical object, and wherein the medical object comprises a sterile medical object.

* * * * *